US010176812B2

(12) United States Patent
Kastner et al.

(10) Patent No.: US 10,176,812 B2
(45) Date of Patent: Jan. 8, 2019

(54) DECODER AND METHOD FOR MULTI-INSTANCE SPATIAL-AUDIO-OBJECT-CODING EMPLOYING A PARAMETRIC CONCEPT FOR MULTICHANNEL DOWNMIX/UPMIX CASES

(71) Applicant: Fraunhofer-Gesellschaft zur Foerderung der angewandten Forschung e.V., Munich (DE)

(72) Inventors: Thorsten Kastner, Erlangen (DE); Juergen Herre, Erlangen (DE); Leon Terentiv, Erlangen (DE); Oliver Hellmuth, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/610,396

(22) Filed: Jan. 30, 2015

(65) Prior Publication Data

US 2015/0149187 A1 May 28, 2015

Related U.S. Application Data

(63) Continuation of application No. PCT/EP2013/066374, filed on Aug. 5, 2013.
(Continued)

(51) Int. Cl.
*G10L 19/00* (2013.01)
*G10L 21/00* (2013.01)
*G10L 19/008* (2013.01)

(52) U.S. Cl.
CPC ..... *G10L 19/008* (2013.01); *H04S 2400/03* (2013.01)

(58) Field of Classification Search
CPC ..... G10L 19/008; G10L 19/20; G10L 19/00; G10L 19/0204; G10L 19/02;
(Continued)

(56) References Cited

U.S. PATENT DOCUMENTS 6,611,212 B1 * 8/2003 Craven ..... G11B 20/00992 341/50
8,280,538 B2 * 10/2012 Kim ..... G10L 19/008 381/17
(Continued)

FOREIGN PATENT DOCUMENTS

CN 101361116 A 2/2009
CN 101529501 A 9/2009
(Continued)

OTHER PUBLICATIONS

Engdegard, J et al., "Spatial Audio Object Coding (SAOC)—The Upcoming MPEG Standard on Parametric Object Based Audio Coding", Audio Engineering Society, Convention Paper, presented at the 124th Convention, May 17-20, 2008, pp. 1-15.

*Primary Examiner* — Michael Ortiz-Sanchez
(74) *Attorney, Agent, or Firm* — Michael A. Glenn; Perkins Coie LLP

(57) ABSTRACT

A decoder for generating an audio output signal having one or more audio output channels from a downmix signal having three or more downmix channels, wherein the downmix signal encodes three or more audio object signals is provided. The decoder includes an input channel router and at least two channel processing units. Each channel processing unit of the at least two channel processing units is configured to generate one or more of at least two processed channels depending on side information and depending on one or more of the three or more downmix channels received by the channel processing unit from the input channel router.

12 Claims, 4 Drawing Sheets

Related U.S. Application Data

(60) Provisional application No. 61/679,412, filed on Aug. 3, 2012.

(58) Field of Classification Search
CPC ..... G10L 19/167; G10L 19/06; G10L 19/173; G10L 19/0018; G10L 19/087; G10L 19/0017; G10L 19/24; G10L 21/0364; H04S 2420/03; H04S 2400/03; H04S 2400/01; H04L 65/607; H04M 3/568
See application file for complete search history.

(56) References Cited

U.S. PATENT DOCUMENTS

2008/0205657 A1 8/2008 Oh et al.
2009/0325524 A1* 12/2009 Oh ..... G10L 19/008 455/205
2010/0094631 A1* 4/2010 Engdegard ..... G10L 19/008 704/258
2011/0002469 A1 1/2011 Ojala et al.
2011/0022402 A1* 1/2011 Engdegard ..... G10L 19/20 704/501
2011/0029113 A1* 2/2011 Ishikawa ..... G10L 19/008 700/94
2011/0029119 A1 2/2011 Ramavajjala et al.
2011/0038423 A1* 2/2011 Lee ..... G10L 19/008 375/240.26
2011/0046964 A1* 2/2011 Moon ..... G10L 19/008 704/500
2011/0196685 A1 8/2011 Kim et al.
2012/0183148 A1 7/2012 Sang et al.
2014/0358567 A1* 12/2014 Koppens ..... G10L 19/008 704/500
2015/0149187 A1* 5/2015 Kastner ..... G10L 19/008 704/500
2015/0162012 A1* 6/2015 Kastner ..... G10L 19/008 704/500
2015/0194158 A1* 7/2015 Oh ..... G10L 19/008 381/22
2016/0140968 A1* 5/2016 Paulus ..... H04S 3/02 381/22

FOREIGN PATENT DOCUMENTS

CN 101542595 A 9/2009
CN 101553868 A 10/2009
CN 101809654 A 8/2010
CN 102016982 A 4/2011
EP 2477188 A1 7/2012
JP 2010507115 A 3/2010
JP 2015531078 A 10/2015
KR 1020090057131 A 6/2009
RU 2355046 C2 5/2009
RU 2417549 C2 4/2011
RU 2449387 C2 4/2012
WO 2012-040897 A1 4/2012
WO WO 2012040897 A1 * 4/2012 ..... G10L 19/008

* cited by examiner

DECODER AND METHOD FOR MULTI-INSTANCE SPATIAL-AUDIO-OBJECT-CODING EMPLOYING A PARAMETRIC CONCEPT FOR MULTICHANNEL DOWNMIX/UPMIX CASES

CROSS-REFERENCE TO RELATED APPLICATIONS

This application is a continuation of copending International Application No. PCT/EP2013/066374, filed Aug. 5, 2013, which is incorporated herein by reference in its entirety, and additionally claims priority from U.S. Application No. 61/679,412, filed Aug. 3, 2012, which is also incorporated herein by reference in its entirety.

BACKGROUND OF THE INVENTION

The present invention relates to a decoder and a method for multi-instance spatial-audio-object-coding (M-SAOC) employing a parametric concept for multichannel downmix/upmix cases.

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example, in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bitrate efficient way. Therefore, one is willing to accept a reasonable tradeoff between audio quality and bitrate requirements in order to avoid an excessive resource load caused by multi-channel/multi-object applications.

Recently, in the field of audio coding, parametric techniques for the bitrate-efficient transmission/storage of multi-channel/multi-object audio signals have been introduced by, e.g., the Moving Picture Experts Group (MPEG) and others. One example is MPEG Surround (MPS) as a channel oriented approach [MPS, BCC], or MPEG Spatial Audio Object Coding (SAOC) as an object oriented approach [JSC, SAOC, SAOC1, SAOC2]. Another object-oriented approach is termed as "informed source separation" [ISS1, ISS2, ISS3, ISS4, ISS5, ISS6]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 2, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band, as depicted in FIG. 2:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (side-information-estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 2. The desired target scene may be, in the extreme case, the rendering of only one source signal out of the mixture (source separation scenario), but also any other arbitrary acoustic scene consisting of the objects transmitted. For example, the output can be a single-channel, a 2-channel stereo or 5.1 multi-channel target scene.

Increasing bandwidth/storage available and ongoing improvements in the field of audio coding allows the user to select from a steadily increasing choice of multi-channel audio productions. Multi-channel 5.1 audio formats are already standard in DVD and Blue-Ray productions. New audio formats like MPEG-H 3D Audio with even more audio transport channels appear at the horizon, which will provide the end-users a highly immersive audio experience.

Parametric audio object coding schemes are currently restricted to a maximum of two downmix channels. They can only be applied to some extend on multi-channel mixtures, for example on only two selected downmix channels. The flexibility these coding schemes offer to the user to adjust the audio scene to his/her own preferences is thus severely limited, e.g., with respect to changing audio level of the sports commentator and the atmosphere in sports broadcast.

Moreover, current audio object coding schemes offer only a limited variability in the mixing process at the encoder side. The mixing process is limited to time-variant mixing of the audio objects; and frequency-variant mixing is not possible.

It would therefore be highly appreciated if improved concepts for audio object coding would be provided.

SUMMARY

An embodiment may have a decoder for generating an audio output signal having one or more audio output channels from a downmix signal having three or more downmix channels, wherein the downmix signal encodes three or more audio object signals, wherein each of the audio object signals indicates a different part of an audio content, wherein said part is associated with a playback level and a spatial position, an input channel router for receiving the three or more downmix channels and for receiving side information, and at least two channel processing units for generating at least two processed channels to obtain the one or more audio output channels, an output channel router, and a renderer, wherein the input channel router is configured to feed each of at least two of the three or more downmix channels into at least one of the at least two channel processing units, so that each of the at least two channel processing units receives one or more of the three or more downmix channels, and so that each of the at least two channel processing units receives less than the total number of the three or more downmix channels, wherein each channel processing unit of the at least two channel processing units is configured to generate one or more of the at least two processed channels depending on said one or more of the at least two of the three or more downmix channels received by said channel processing unit from the input channel router, and depending on the side information having downmix information, which indicates how the audio object signals have been downmixed to obtain the three or more downmix channels, and further having information on a covariance matrix of size N×N, wherein N indicates the number of the three or more audio object signals, wherein the covariance matrix indicates for the N audio object signals, which are encoded within the downmix signal, the object level difference parameters and the inter-object correlations parameters of the N audio object signals, wherein the at least two channel processing units are configured to generate the at least two processed channels in parallel, wherein the output channel router is adapted to combine the at least two processed channels to obtain an estimation of the audio object signals, and wherein the renderer is configured to receive rendering information and to generate the one or more audio output channels depending on the estimation of the audio object signals and depending on the rendering information.

Another embodiment may have a method for generating an audio output signal having one or more audio output channels from a downmix signal having three or more downmix channels, wherein the downmix signal encodes three or more audio object signals, wherein each of the audio object signals indicates a different part of an audio content, wherein said part is associated with a playback level and a spatial position, receiving the three or more downmix channels and receiving side information by an input channel router, feeding each of at least two of the three or more downmix channels into at least one of at least two channel processing units, so that each of the at least two channel processing units receives one or more of the three or more downmix channels, and so that each of the at least two channel processing units receives less than the total number of the three or more downmix channels, generating at least two processed channels by the at least two channel processing units to obtain the one or more audio output channels, generating one or more of the at least two processed channels by each channel processing unit of the at least two channel processing units depending on said one or more of the at least two of the three or more downmix channels received by said channel processing unit from the input channel router, and depending on the side information having downmix information, which indicates how the audio object signals have been downmixed to obtain the three or more downmix channels, and further having information on a covariance matrix of size N×N, wherein N indicates the number of the three or more audio object signals, wherein the covariance matrix indicates for the N audio object signals, which are encoded within the downmix signal, the object level difference parameters and the inter-object correlations parameters of the N audio object signals, wherein generating the at least two processed channels by the at least two channel processing units is conducted in parallel, combining the at least two processed channels by an output channel router to obtain an estimation of the audio object signals, receive rendering information by a renderer, and generating the one or more audio output channels by the renderer depending on the estimation of the audio object signals and depending on the rendering information.

Another embodiment may have a computer program for implementing the inventive method when being executed on a computer or signal processor.

A decoder for generating an audio output signal comprising one or more audio output channels from a downmix signal comprising three or more downmix channels, wherein the downmix signal encodes three or more audio object signals is provided.

The decoder comprises an input channel router for receiving the three or more downmix channels and for receiving side information, and at least two channel processing units for generating at least two processed channels to obtain the one or more audio output channels.

The input channel router is configured to feed each of at least two of the three or more downmix channels into at least one of the at least two channel processing units, so that each of the at least two channel processing units receives one or more of the three or more downmix channels, and so that each of the at least two channel processing units receives less than the total number of the three or more downmix channels.

Each channel processing unit of the at least two channel processing units is configured to generate one or more of the at least two processed channels depending on the side information and depending on said one or more of the at least two of the three or more downmix channels received by said channel processing unit from the input channel router.

More flexibility in the mixing process allows an optimal exploitation of signal object characteristics. A downmix can be produced which is optimized for the parametric separation at the decoder side regarding perceived quality.

Embodiments extend the parametric part of the SAOC scheme to an arbitrary number of downmix/upmix channels. The inventive method further allows fully flexible mixing of the audio objects.

According to an embodiment, the input channel router may be configured to feed each of the at least two of the three or more downmix channels into exactly one of the at least two channel processing units.

In an embodiment, the input channel router may be configured to feed each of the three or more downmix channels into at least one of the at least two channel processing units, so that each of the three or more downmix channels is received by one or more of the at least two channel processed units.

According to an embodiment, each of the at least two channel processing units may be configured to generate said one or more of the at least two processed channels independent from at least one of three or more downmix channels.

In an embodiment, each of the at least two channel processing units may either be a mono processing unit or a stereo processing unit, wherein said mono processing unit may be configured to receive exactly one of the three or more downmix channels and is configured to generate exactly one or exactly two of the at least two processed channels depending on said exactly one of the three or more downmix channels and depending on the side information, and wherein said stereo processing unit may be configured to receive exactly two of the three or more downmix channels and is configured to generate exactly one or exactly two of the at least two processed channels depending on said exactly two of the three or more downmix channels and depending on the side information.

At least one of the at least two channel processing units may be configured to receive exactly one of the three or more downmix channels and being configured to generate exactly two of the at least two processed channels depending on said exactly one of the three or more downmix channels and depending on the side information.

According to an embodiment, at least one of the at least two channel processing units may be configured to receive exactly two of the three or more downmix channels and being configured to generate exactly one of the at least two processed channels depending on said exactly two of the three or more downmix channels and depending on the side information.

In an embodiment, the input channel router may be configured to receive four or more downmix channels, and at least one of the at least two channel processing units may be configured to receive at least three of the four or more downmix channels and may be configured to generate at least three of the processed channels depending on said at least three of the four or more downmix channels and depending on the side information.

According to an embodiment, at least one of the at least two channel processing units may be configured to receive exactly three of the four or more downmix channels and may be configured to generate exactly three of the processed channels depending on said exactly three of the four or more downmix channels and depending on the side information.

In an embodiment, the input channel router may be configured to receive six or more downmix channels, and wherein at least one of the at least two channel processing units may be configured to receive exactly five of the six or more downmix channels and is configured to generate exactly five of the processed channels depending on said exactly five of the six or more downmix channels and depending on the side information.

In an embodiment, the input channel router is configured to not feed at least one of the three or more downmix channels into any of the at least two channel processing units, so that said at least one of the three or more downmix channels is not received by any of the at least two channel processed units.

According to an embodiment, the decoder may further comprise an output channel router for combining the at least two processed channels to obtain the one or more audio output channels.

In an embodiment, the decoder may further comprise a renderer, wherein the renderer may be configured to receive rendering information, and wherein the renderer is configured to generate the one or more audio output channels depending on the at least two processed channels and depending on the rendering information.

According to an embodiment, the at least two channel processing units may be configured to generate the at least two processed channels in parallel.

According to an embodiment, a first channel processing unit of the at least two channel processing units may be configured to feed a first processed channel of the at least two processed channels into a second channel processing unit of the at least two channel processing units. Said second processing unit may be configured to generate a second processed channel of the at least two processed channels depending on the first processed channel.

Moreover, a method for generating an audio output signal comprising one or more audio output channels from a downmix signal comprising three or more downmix channels is provided. The downmix signal encodes three or more audio object signals. The method comprises:

Receiving the three or more downmix channels and for receiving side information by an input channel router, Feeding each of at least two of the three or more downmix channels into at least one of the at least two channel processing units, and Generating at least two processed channels by at least two channel processing units to obtain the one or more audio output channels, Feeding each at least two of the three or more downmix channels into at least one of the at least two channel processing units by the input channel router is conducted, so that each of the at least two channel processing units receives one or more of the three or more downmix channels, and so that each of the at least two channel processing units receives less than the total number of the three or more downmix channels.

Generating the at least two processed channels is conducted by generating one or more of the at least two processed channels by each channel processing unit of the at least two channel processing units depending on the side information and depending on said one or more of the at least two of the three or more downmix channels received by said channel processing unit from the input channel router.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing embodiments of the present invention, more background on state-of-the-art-SAOC systems is provided.

Figure 2:
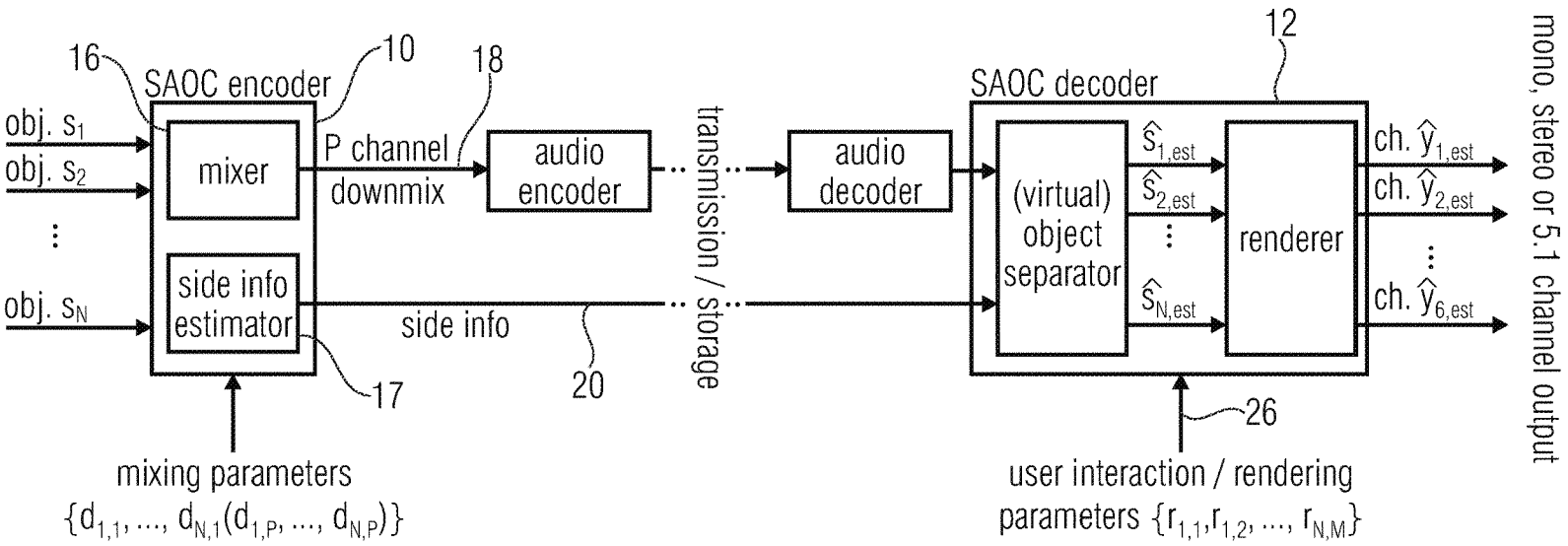
FIG. 2 is a SAOC system overview depicting the principle of such systems using the example of MPEG SAOC.

FIG. 2 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 2, the downmix signal is shown to be a P-channel signal. Thus, any mono (P=1), stereo (P=2) or multi-channel (P>2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_1$ to $s_N$, side-information estimator 17 provides the SAOC decoder 12 with side information including SAOC-parameters. For example, in case of a stereo downmix, the SAOC parameters comprise object level differences (OLD), inter-object correlations (IOC) (inter-object cross correlation parameters), downmix gain values (DMG) and downmix channel level differences (DCLD). The side information 20, including the SAOC-parameters, along with the downmix signal 18, forms the SAOC output data stream received by the SAOC decoder 12.

The SAOC decoder 12 comprises an up-mixer which receives the downmix signal 18 as well as the side information 20 in order to recover and render the audio signals $\hat{s}_1$ and $\hat{s}_N$ onto any user-selected set of channels $\hat{y}_1$ to $\hat{y}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

Figure 1:
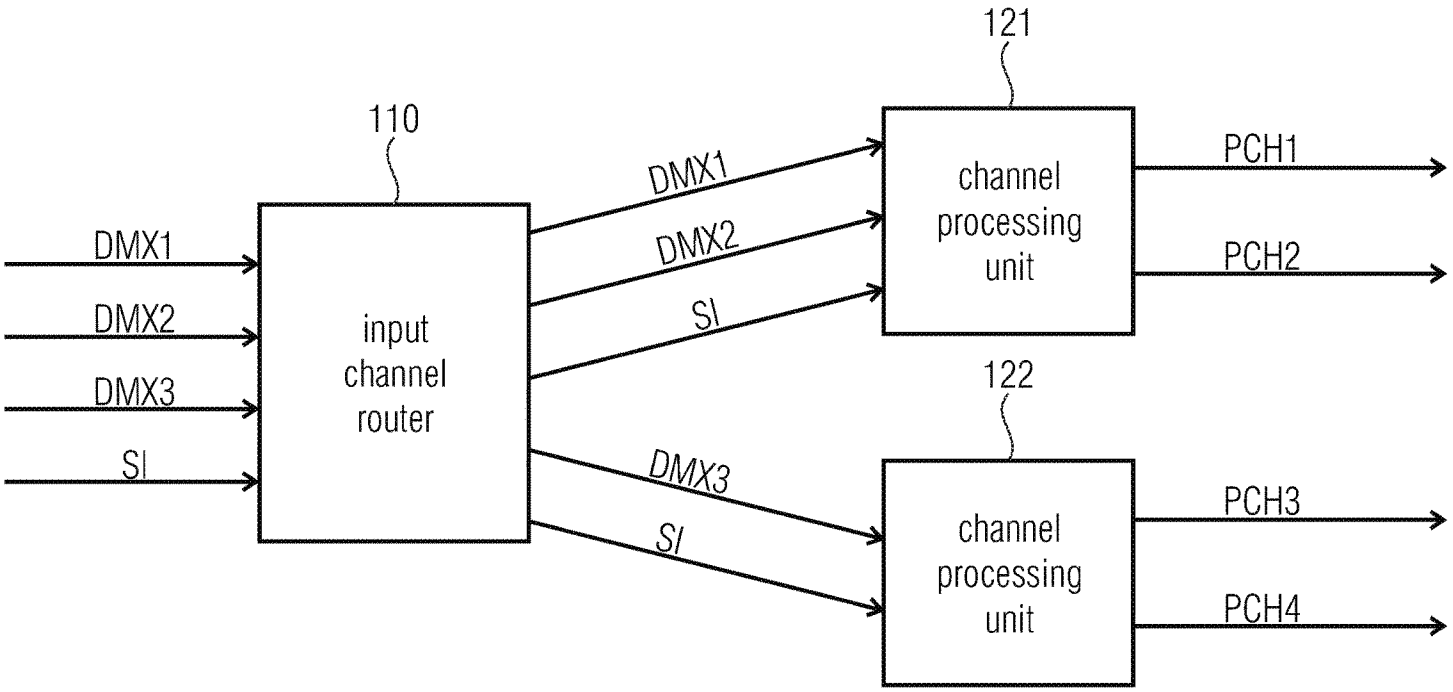
FIG. 1 is a decoder for generating an audio output signal according to an embodiment.

FIG. 1 illustrates a decoder for generating an audio output signal comprising one or more audio output channels from a downmix signal comprising three or more downmix channels according to an embodiment. The downmix signal encodes three or more audio object signals.

The decoder comprises an input channel router 110 for receiving the three or more downmix channels DMX1, DMX2, DMX3 and for receiving side information SI, and at least two channel processing units 121, 122 for generating at least two processed channels to obtain the one or more audio output channels.

The input channel router 110 is configured to feed each of at least two of the three or more downmix channels DMX1, DMX2 DMX3 into at least one of the at least two channel processing units 121, 122, so that each of the at least two channel processing units 121, 122 receives one or more of the three or more downmix channels, and so that each of the at least two channel processing units 121, 122 receives less than the total number of the three or more downmix channels DMX1, DMX2, DMX3.

In particular, in the embodiment of FIG. 1, each of the three downmix channels DMX1, DMX2, DMX3 are fed into exactly one channel processing unit. However, in other embodiments, not all of the three or more downmix channels received by the input channel router 110 may be fed into a processing unit. However, in any case, each of at least two downmix channels of the three or more downmix channels will be fed into at least one of the channel processing units.

Each channel processing unit of the at least two channel processing units 121, 122 is configured to generate one or more of the at least two processed channels depending on the side information SI and depending on said one or more of the at least two of the three or more downmix channels (DMX1, DMX2, DMX3) received by said channel processing unit 121, 122, from the input channel router 110.

In the example of FIG. 1, channel processing unit 121 receives two downmix channels (DMX1 DMX2) for generating two processed channels (PCH1, PCH2). Thus, processing unit 121 may be considered as a stereo-to-stereo processing unit.

Moreover, in the example of FIG. 1, channel processing unit 122 receives downmix channel DMX3 for generating two processed channels (PCH3, PCH4).

In the example of FIG. 1, the processed channels PCH1, PCH2, PCH3, PCH4 are the audio output channels generated by the decoder. However, in other embodiments, the audio output channels are generated depending on the processed channels e.g. by employing rendering information.

Generating the processed channels from the downmix channels is done by employing side information. The side information may for example comprise downmix information which indicates how audio objects have been downmixed to obtain the three or more downmix channels. Moreover, the side information may also comprise information on a covariance matrix of size N×N, which may indicate for N audio objects or N audio object signals, which are encoded, the OLD and IOC parameters of these N audio objects.

A channel processing unit of the at least two processing units 121, 122 may, for example, be a mono-to-mono processing unit which implements a mono to mono "x-1-1" processing mode. Or, a channel processing unit of the at least two processing units 121, 122 may, for example, be configured to implement a mono to stereo "x-1-2" processing mode. Or, a channel processing unit of the at least two processing units 121, 122 may, for example, be configured to implement a stereo to mono "x-2-1" processing mode. Or, a channel processing unit of the at least two processing units 121, 122 may, for example, be a stereo-to-stereo processing unit which implements a stereo to stereo "x-2-2" processing mode.

The mono to mono "x-1-1" processing mode, the mono to stereo "x-1-2" processing mode, the stereo to mono "x-2-1" processing mode and the stereo to stereo "x-2-2" processing mode are described in the SAOC Standard (see [SAOC]), as decoding modes of the SAOC standard.

In particular, see, for example: ISO/IEC, "MPEG audio technologies—Part 2: Spatial Audio Object Coding (SAOC)," ISO/IEC JTC1/SC29/WG11 (MPEG) International Standard 23003-2:2010, in particular, see, chapter "SAOC Processing", more particularly, see subchapter "Decoding modes".

In an embodiment, each of the at least two channel processing units 121, 122 may either be a mono processing unit or a stereo processing unit, wherein said mono processing unit is configured to receive exactly one of the three or more downmix channels and is configured to generate exactly one or exactly two of the at least two processed channels depending on said exactly one of the three or more downmix channels and depending on the side information, and wherein said stereo processing unit is configured to receive exactly two of the three or more downmix channels and is configured to generate exactly one or exactly two of the at least two processed channels depending on said exactly two of the three or more downmix channels and depending on the side information.

At least one of the at least two channel processing units 121, 122 may be configured to receive exactly one of the three or more downmix channels and being configured to generate exactly two of the at least two processed channels depending on said exactly one of the three or more downmix channels and depending on the side information.

According to an embodiment, at least one of the at least two channel processing units 121, 122 may be configured to receive exactly two of the three or more downmix channels and is configured to generate exactly one of the at least two processed channels depending on said exactly two of the three or more downmix channels and depending on the side information.

A channel processing unit of the at least two processing units 121, 122 may, for example, implement a mono downmix ("x-1-5") processing mode for generating five processed channels from a mono downmix channel. Or, a channel processing unit of the at least two processing units 121, 122 may, for example, implement a stereo downmix ("x-2-5") processing mode for generating five processed channels from a two downmix channels.

The mono downmix ("x-1-5") processing mode and the stereo downmix ("x-2-5") processing mode are described in the SAOC Standard (see [SAOC]), as transcoding modes of the SAOC standard.

In particular, see, for example: ISO/IEC, "MPEG audio technologies—Part 2: Spatial Audio Object Coding (SAOC)," ISO/IEC JTC1/SC29/WG11 (MPEG) International Standard 23003-2:2010, in particular, see, chapter "SAOC Processing", more particularly, see subchapter "Transcoding modes".

However, in some embodiments, one, some or all of the channel processing units 121, 122 may be configured differently.

In an embodiment, the input channel router 110 may be configured to receive four or more downmix channels, and at least one of the at least two channel processing units 121, 122 may be configured to receive at least three of the four or more downmix channels and may be configured to generate at least three of the processed channels depending on said at least three of the four or more downmix channels and depending on the side information.

According to an embodiment, at least one of the at least two channel processing units 121, 122 may be configured to receive exactly three of the four or more downmix channels and may be configured to generate exactly three of the processed channels depending on said exactly three of the four or more downmix channels and depending on the side information.

In an embodiment, the input channel router 110 may be configured to receive six or more downmix channels, and wherein at least one of the at least two channel processing units 121, 122 may be configured to receive exactly five of the six or more downmix channels and is configured to generate exactly five of the processed channels depending on said exactly five of the six or more downmix channels and depending on the side information.

According to an embodiment, the input channel router may be configured to feed each of the at least two of the three or more downmix channels into exactly one of the at least two channel processing units 121, 122. Thus, none of the downmix channels DMX1, DMX2, DMX3 is fed into two or more of the channel processing units 121, 122, as, e.g. in the example of FIG. 1. However, in other embodiments, one or more of the downmix channels may be fed into more than one channel processing unit.

In an embodiment, the input channel router 110 may be configured to feed each of the three or more downmix channels into at least one of the at least two channel processing units 121, 122, so that each of the three or more downmix channels is received by one or more of the at least two channel processed units 121, 122. However, in other embodiments, the input channel router 110 is configured to not feed at least one of the three or more downmix channels into any of the at least two channel processing units 121, 122, so that said at least one of the three or more downmix channels is not received by any of the at least two channel processed units.

According to an embodiment, each of the at least two channel processing units 121, 122 may be configured to generate said one or more of the at least two processed channels independent from at least one of the three or more downmix channels. In other words, none of the channel processing unit receives all of the downmix channels DMX1, DMX2, DMX3, as illustrated by FIG. 1.

According to embodiments, the multichannel downmix processing functionality can be realized by the (cascaded or/and parallel) application of multiple SAOC decoders/transcoder instances (or their parts).

Figure 3:
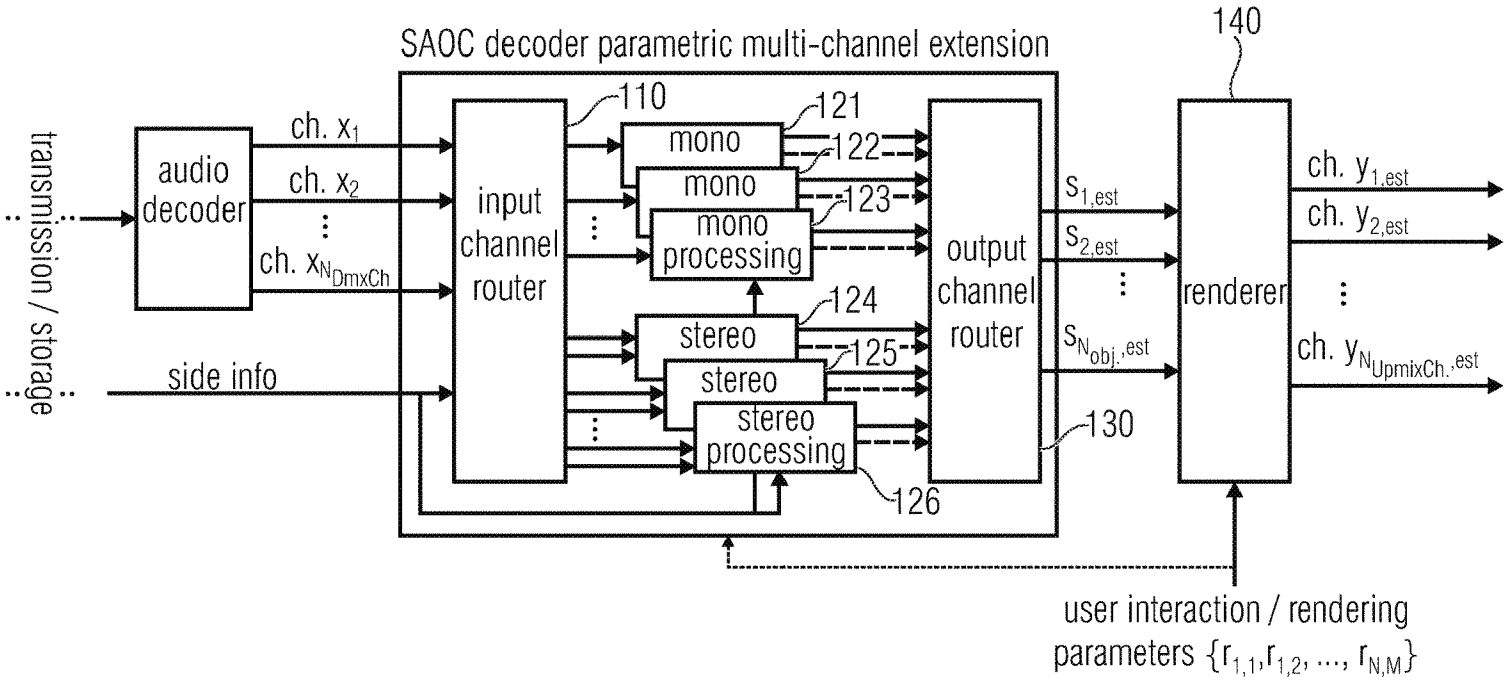
FIG. 3 depicts a schematic illustration showing the principle of combining multiple SAOC mono and stereo decoders/transcoder instances in parallel to parametrically decode a multi-channel signal mixture according to an embodiment.

FIG. 3 depicts a schematic illustration showing the principle of combining multiple SAOC mono and stereo decoders/transcoder instances in parallel to parametrically decode a multi-channel signal mixture according to an embodiment.

In particular, in FIG. 3, the multiple SAOC mono and stereo decoder/transcoder instances are driven in parallel to process the multi-channel downmix.

For example, the channel processing units 121, 122, 123, 124, 125, 126 of FIG. 3 may be configured to generate the at least two processed channels in parallel. For example, the channel processing units 121, 122, 123, 124, 125, 126 may be configured to generate the at least two processed channels in parallel so that each of the at least two channel processing units starts generating one of the at least two processed channels, before any other channel processing unit of the at least two channel processing units finishes generating another one of the at least two processed channels.

The input channel router 110 of FIG. 3 routes the input channels to the several decoders/transcoders. It should be noted that the decoders/transcoders can be driven with any arbitrary number of input channels and are not restricted to mono or stereo signals only, as depicted in FIG. 3 for visual clarity.

According to the embodiment of FIG. 3, the decoder further comprises an output channel router 130 for combining the at least two processed channels to obtain the one or more audio output channels. The (processed) signals processed from the decoders/transcoders units are fed into the output channel router 130. The output channel router 130 combines the several input streams and yields a final estimation of the audio object signals to the renderer 140.

In the embodiment illustrated by FIG. 3, the decoder further comprises a renderer 140. The renderer 140 is configured to receive rendering information, wherein the renderer is configured to generate the one or more audio output channels depending on the at least two processed channels and depending on the rendering information.

It should be noted that, parametric processing needs only to be applied to the downmix channels of interest. Computational complexity can thus be reduced. Downmix signals can be completely bypassed from the processing if they are not needed (e.g. surround channels can be bypassed if only the front scene is manipulated). In those embodiments, not all of the three or more downmix channels received by the input channel router 110 are fed into the channel processing unit, but only a subset of these received downmix channels. In any case, however, at least two downmix channels of the three or more received downmix channels are provided to the channel processing units.

Figure 4:
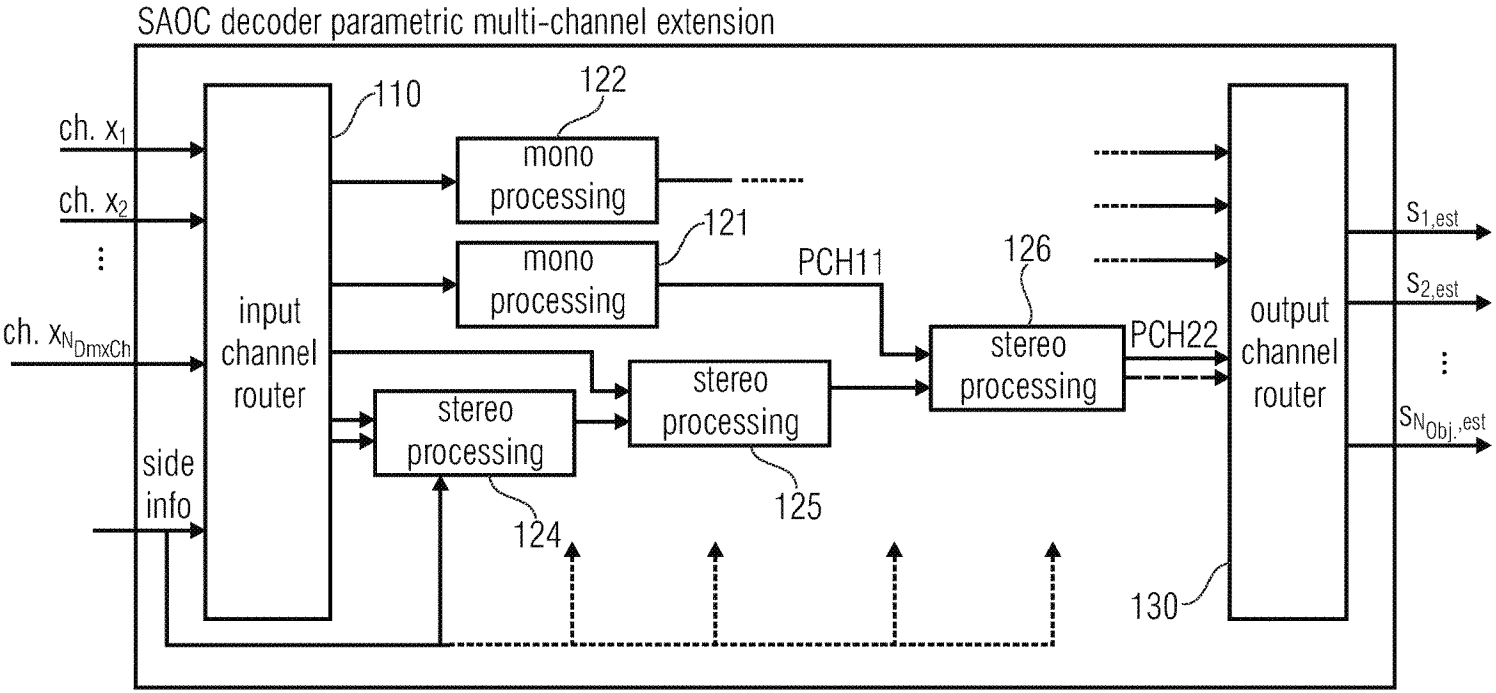
FIG. 4 depicts a schematic diagram illustrating the principle of a cascaded SAOC mono and stereo decoders/transcoder structure to process a multi-channel signal mixture according to an embodiment.

FIG. 4 depicts a schematic diagram illustrating the principle of a cascaded SAOC mono and stereo decoders/transcoder structure to process a multi-channel signal mixture according to an embodiment.

According to such embodiment illustrated by FIG. 4, a first channel processing unit 121 of the at least two channel processing units may be configured to feed a first processed channel PCH11 of the at least two processed channels into a second channel processing unit 126 of the at least two channel processing units. Said second processing unit 126 may be configured to generate a second processed channel PCH22 of the at least two processed channels depending on the first processed channel PCH11.

The combination of several decoders/transcoders can be static and given a priori, but also be adapted dynamically.

This approach represents a fully SAOC backward compatible extension method of handling multichannel downmix systems.

The presented inventive embodiments can be applied on an arbitrary number of downmix/upmix channels. It can be combined with any current and also future audio formats.

The flexibility of the inventive method allows bypassing of unaltered channels to reduce computational complexity, reduce bitstream payload/reduced data amount.

Some embodiments relate to an audio encoder, method or computer program for encoding. Moreover, some embodiments relate to an audio decoder, method or computer program for decoding as described above. Furthermore, some embodiments relate to an encoded signal.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise a non-transitory computer-readable medium comprising a computer program for one of the methods described herein, when being executed on a computer or signal processor.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[MPS] ISO/IEC 23003-1:2007, MPEG-D (MPEG audio technologies), Part 1: MPEG Surround, 2007.

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Holzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008

[SAOC] ISO/IEC, "MPEG audio technologies—Part 2: Spatial Audio Object Coding (SAOC)," ISO/IEC JTC1/SC29/WG11 (MPEG) International Standard 23003-2.

[ISS1] M. Parvaix and L. Girin: "Informed Source Separation of underdetermined instantaneous Stereo Mixtures using Source Index Embedding", IEEE ICASSP, 2010

[ISS2] M. Parvaix, L. Girin, J.-M. Brossier: "A watermarking-based method for informed source separation of audio signals with a single sensor", IEEE Transactions on Audio, Speech and Language Processing, 2010

[ISS3] A. Liutkus and J. Pinel and R. Badeau and L. Girin and G. Richard: "Informed source separation through spectrogram coding and data embedding", Signal Processing Journal, 2011

[ISS4] A. Ozerov, A. Liutkus, R. Badeau, G. Richard: "Informed source separation: source coding meets source separation", IEEE Workshop on Applications of Signal Processing to Audio and Acoustics, 2011

[ISS5] Shuhua Zhang and Laurent Girin: "An Informed Source Separation System for Speech Signals", INTERSPEECH, 2011

[ISS6] L. Girin and J. Pinel: "Informed Audio Source Separation from Compressed Linear Stereo Mixtures", AES 42nd International Conference: Semantic Audio, 2011

The invention claimed is:

1. An audio decoder for generating an audio output signal comprising one or more audio output channels from a downmix signal comprising three or more downmix channels, wherein the downmix signal encodes three or more audio object signals, wherein the audio decoder comprises:

an input channel router for receiving the three or more downmix channels and for receiving side information, and at least two channel processing units for generating at least two processed channels to obtain the one or more audio output channels, wherein the input channel router is configured to feed each of at least two of the three or more downmix channels into at least one of the at least two channel processing units, so that each of the at least two channel processing units receives one or more of the three or more downmix channels, and so that each of the at least two channel processing units receives less than the total number of the three or more downmix channels, wherein each channel processing unit of the at least two channel processing units is configured to generate one or more of the at least two processed channels depending on the side information and depending on said one or more of the at least two of the three or more downmix channels received by said channel processing unit from the input channel router, wherein the at least two channel processing units are configured to generate the at least two processed channels in parallel, wherein the audio decoder further comprises an output channel router, wherein the output channel router is configured to combine the at least two processed channels to obtain an estimation of the audio object signals, wherein the audio decoder further comprises a renderer, wherein the renderer is configured to receive rendering information and is configured to generate the one or more audio output channels depending on the estimation of the audio object signals and depending on the rendering information, wherein the input channel router is configured to not feed at least one of the three or more downmix channels into any of the at least two channel processing units, so that said at least one of the three or more downmix channels is not received by any of the at least two channel processing units, wherein the audio decoder is implemented using a hardware apparatus or using a computer or using a combination of a hardware apparatus and a computer.

2. The audio decoder according to claim 1, wherein the input channel router is configured to feed each of the at least two of the three or more downmix channels into exactly one of the at least two channel processing units.

3. The audio decoder according to claim 1, wherein each of the at least two channel processing units is configured to generate said one or more of the at least two processed channels independent from at least one of the three or more downmix channels.

4. The audio decoder according to claim 1, wherein each of the at least two channel processing units is either a mono processing unit or a stereo processing unit, wherein said mono processing unit is configured to receive exactly one of the three or more downmix channels and is configured to generate exactly one or exactly two of the at least two processed channels depending on said exactly one of the three or more downmix channels and depending on the side information, and wherein said stereo processing unit is configured to receive exactly two of the three or more downmix channels and is configured to generate exactly one or exactly two of the at least two processed channels depending on said exactly two of the three or more downmix channels and depending on the side information.

5. The audio decoder according to claim 1, wherein at least one of the at least two channel processing units is configured to receive exactly one of the three or more downmix channels and is configured to generate exactly two of the at least two processed channels depending on said exactly one of the three or more downmix channels and depending on the side information.

6. The audio decoder according to claim 1, wherein at least one of the at least two channel processing units is configured to receive exactly two of the three or more downmix channels and is configured to generate exactly one of the at least two processed channels depending on said exactly two of the three or more downmix channels and depending on the side information.

7. The audio decoder according to claim 1, wherein the input channel router is configured to receive four or more downmix channels, and wherein at least one of the at least two channel processing units is configured to receive at least three of the four or more downmix channels and is configured to generate at least three of the processed channels depending on said at least three of the four or more downmix channels and depending on the side information.

8. The audio decoder according to claim 7, wherein at least one of the at least two channel processing units is configured to receive exactly three of the four or more downmix channels and is configured to generate exactly three of the processed channels depending on said exactly three of the four or more downmix channels and depending on the side information.

9. The audio decoder according to claim 7, wherein the input channel router is configured to receive six or more downmix channels, and wherein at least one of the at least two channel processing units is configured to receive exactly five of the six or more downmix channels and is configured to generate exactly five of the processed channels depending on said exactly five of the six or more downmix channels and depending on the side information.

10. The audio decoder according to claim 1, wherein a first channel processing unit of the at least two channel processing units is configured to feed a first processed channel of the at least two processed channels into a second channel processing unit of the at least two channel processing units, and wherein said second processing unit is configured to generate a second processed channel of the at least two processed channels depending on the first processed channel.

11. A method for generating an audio output signal comprising one or more audio output channels from a downmix signal comprising three or more downmix channels, wherein the downmix signal encodes three or more audio object signals, wherein the method comprises:

receiving the three or more downmix channels and for receiving side information by an input channel router, feeding each of at least two of the three or more downmix channels into at least one of the at least two channel processing units, and generating at least two processed channels by at least two channel processing units to obtain the one or more audio output channels, wherein feeding each at least two of the three or more downmix channels into at least one of the at least two channel processing units by the input channel router is conducted, so that each of the at least two channel processing units receives one or more of the three or more downmix channels, and so that each of the at least two channel processing units receives less than the total number of the three or more downmix channels, wherein generating the at least two processed channels is conducted by generating one or more of the at least two processed channels by each channel processing unit of the at least two channel processing units depending on the side information and depending on said one or more of the at least two of the three or more downmix channels received by said channel processing unit from the input channel router, wherein generating the at least two processed channels by the at least two channel processing units is conducted in parallel, wherein the method further comprises combining the at least two processed channels by an output channel router to obtain an estimation of the audio object signals, and wherein the method further comprises receiving rendering information by a renderer, and wherein the method further comprises generating the one or more audio output channels by the renderer depending on the estimation of the audio object signals and depending on the rendering information, wherein at least one of the three or more downmix channels is not fed by the input channel router into any of the at least two channel processing units, so that said at least one of the three or more downmix channels is not received by any of the at least two channel processing units, wherein the method is performed using a hardware apparatus or using a computer or using a combination of a hardware apparatus and a computer.

12. A non-transitory computer-readable medium comprising a computer program for implementing the method of claim 11 when being executed on a computer or signal processor.

* * * * *